United States Patent [19]

Nagatomo et al.

[11] 4,266,010

[45] * May 5, 1981

[54] SILVER HALIDE PHOTOGRAPHIC LIGHT-SENSITIVE MATERIAL

[75] Inventors: Shigeru Nagatomo; Kiyotaka Hori, both of Minami-ashigara, Japan

[73] Assignee: Fuji Photo Film Co., Ltd., Minami-ashigara, Japan

[ * ] Notice: The portion of the term of this patent subsequent to May 3, 1994, has been disclaimed.

[21] Appl. No.: 26,137

[22] Filed: Mar. 30, 1979

Related U.S. Application Data

[63] Continuation of Ser. No. 592,293, Jul. 1, 1975, abandoned.

[30] Foreign Application Priority Data

Jul. 1, 1974 [JP] Japan ..... 49-75516

[51] Int. Cl.[3] ..... G03C 5/26; G03C 1/78

[52] U.S. Cl. ..... 430/355; 430/539; 430/543; 430/642; 430/950; 430/961

[58] Field of Search ..... 96/87, 114 R, 67, 50 PL; 430/950, 961, 355, 539, 542, 642

[56] References Cited

U.S. PATENT DOCUMENTS

| | | | |
|---|---|---|---|
| 3,232,756 | 2/1966 | Yackel et al. | 96/87 R |
| 3,253,926 | 5/1966 | Van Pee | 96/114 |
| 3,291,611 | 12/1966 | Krajewski | 96/114 |
| 3,923,517 | 12/1975 | Yamamoto et al. | 96/110 |
| 4,021,244 | 5/1977 | Nagatomo et al. | 96/67 |
| 4,021,245 | 5/1977 | Nagatomo et al. | 96/50 PL |

*Primary Examiner*—Mary F. Downey

*Attorney, Agent, or Firm*—Sughrue, Rothwell, Mion, Zinn and Macpeak

[57] ABSTRACT

A silver halide photographic light-sensitive material containing at least one photographic layer containing acid-processed gelatin and a matting agent.

10 Claims, No Drawings

SILVER HALIDE PHOTOGRAPHIC LIGHT-SENSITIVE MATERIAL

This is a continuation of application Ser. No. 592,293, filed July 1, 1975, now abandoned.

BACKGROUND OF THE INVENTION

1. Field of the Invention

This invention relates to a silver halide photographic light-sensitive material and more particularly, to a silver halide photographic light-sensitive material which has improved processing properties and surface characteristics.

2. Description of the Prior Art

In photographic light-sensitive materials, natural hydrophilic high molecular weight materials such as gelatin and/or synthetic hydrophilic high molecular weight materials are usually contained in a silver halide emulsion layer, photographic auxiliary layers such as an intermediate layer, a protective layer and an antihalation layer, and a subbing layer interposed between the above layers and a support. Photographic light-sensitive materials containing hydrophilic high molecular weight materials are usually processed, to form photographic images after exposure with various aqueous solutions having different pH's and salt concentrations at different temperatures for development, stopping, fixing, washing and the like (bleaching is also conducted for color light-sensitive materials).

However, when the photographic light-sensitive material is processed at a higher temperature as in rapid processing, i.e., the procedures used to form images through rapid development and other photographic processings, or when processing requires a long time since the processing includes many steps for various purposes as in the processing of color reversal photographic materials, many disadvantages occur. For example, the photographic light-sensitive emulsion layers and other layers swell excessively and soften, thus with the physical strength being reduced and often resulting in the occurrence of a reticulate pattern, which is referred to as reticulation, on the surface thereof.

These phenomena are undesirable since they markedly decrease the commercial value of photographic light-sensitive materials both for black-and-white photography and for color photography. In recent years, methods for processing a photographic light-sensitive material have become varied, and, as a result, a shortening of the time required for each processing step and thus an improvement in the rate of conducting the photographic processing steps by processing at higher temperatures such as 30° C., 38° C. or 50° C., and not at conventional temperatures near room temperature such as 20° C. or 24° C., have been desired.

As one of the techniques which can be used to satisfy these requirements, incorporation of a large amount of a hardening agent, such as several times to about twenty times the conventional amount, in a photographic light-sensitive emulsion layer or a protective layer in preparing a photographic light-sensitive material, thus imparting, to the photographic light-sensitive material, physical strength to withstand severe processing conditions has previously been considered. However, although this method prevents the occurrence of reticulation to some extent, a substantially complete prevention is not achieved and, in addition, a phenomenon known as "after-hardening", in which the physical strength of an emulsion film gradually changes during the storage of the photographic light-sensitive material, tends to occur, so that maintenance of photographic qualities is difficult. Moreover, this method has the disadvantage that the penetration and diffusion of a developer are hindered in development processing because the degree of hardening of the photographic layers is too high and, thus, sensitivity is substantially reduced.

Other techniques involve subjecting a photographic light-sensitive material after exposure to processing with a bath of an aqueous solution containing a hardening agent, which is referred to as a prehardening bath, immediately before development, or to carry out development and hardening at the same time using a developer also containing a hardening agent. However, these methods have the defects that undesirable results such as fog, a deterioration of other photographic properties, or color contamination, particularly, in color light-sensitive materials, are obtained in using certain types of hardening agents, and that in order to provide photographic layers having the required physical strength within a short processing time without deteriorating the photographic properties, the kind of a hardening agent, as well as the kind of a light-sensitive material applicable, and processing conditions are narrowly restricted. In particular, the method involving processing with a prehardening bath is not a very good technique to use in shortening the photographic processing time and simplifying the processing steps because the number of processing steps is increased.

As another reported method of controlling the occurrence of reticulation, carboxymethylated casein or ethyl cellulose sulfate sodium salt, in place of a gelatin protective layer, is previously coated as an uppermost layer on the emulsion layer side of a photographic light-sensitive material (e.g., as described in U.S. Defensive Publication T887,012). This method is considered to be advantageous in that it is not necessary to incorporate a large amount of a hardening agent in a photographic layer. However, carboxymethylated casein is disadvantageous in that removal therefrom of impurities which have an undesirable effect on photographic properties is difficult, and also, from the viewpoint of the preparation of a photographic light-sensitive material, that it is difficult to form a uniform coated layer on an emulsion layer using an aqueous solution of carboxymethylated casein. On the other hand, ethyl cellulose sulfate sodium salt having good solubility in water is difficult to produce with satisfactory reproducibility. Further, ethyl cellulose sulfate sodium salt also has the defects, for example, that the material has poor long-term storage stability, as might be supposed from the chemical structure of sulfate esters, and also the material is not settable, which is the ability to solidify on cooling after coating, and has poor coating properties. Therefore, ethyl cellulose sulfate sodium salt is not always suitable as a component for use in the preparation of a photographic light-sensitive material.

Silver halide photographic materials usually have a surface layer containing a hydrophilic colloid, of which gelatin is representative, as a binder. Therefore, under high temperature and high humidity conditions the surface of the photographic materials has increased adhesiveness or tackiness and, thus, the photographic materials easily adhere to other materials on contact therewith. This adhesion happens between photographic materials or between the photographic material and another object which contacts the photographic material during the preparation of the photographic materials, photographing, processing, projection and storage, which often causes various problems.

A method which overcomes the above-described problem and is well known to those skilled in the art involves incorporation of an inorganic material such as silicon dioxide, magnesium oxide, titanium dioxide or calcium carbonate, or finely divided particles of an organic material such as polymethyl methacrylate or cellulose acetate propionate in a surface layer, thereby coarsening the surface layer, that is, forming a so-called matted surface, and thus decreasing the adhesiveness. However, such a method is, in practice, disadvantageous in that the following undesirable secondary effects arise: a uniform coated layer can not be obtained since aggregates are formed in a coating solution containing the above-described material; the photographic material tends to be damaged because of the poor smoothness of the material; the movement of a film in a camera or projector is more difficult; the transparency of the images formed is decreased; the graininess of the images formed is impaired; or the like. Accordingly, development of a method for improving the adhesion resistance of a photographic material without the above undesirable secondary effects has been required.

As was described above, reticulation and adhesion are very important problems in the photographic industry, but is is difficult to solve these two problems at the same time using conventional techniques.

SUMMARY OF THE INVENTION

An object of this invention is to provide a photographic light-sensitive material which can be used to rapidly form images of a high quality by photographic processings.

Another object of this invention is to provide a photographic light-sensitive material having excellent adhesion resistance in which reticulation by processing at higher temperatures does not occur.

A further object of this invention is to provide a photographic light-sensitive material having excellent adhesion resistance in which adhesion difficulties during the preparation of the light-sensitive material seldom or never occur.

Various approaches have been studied and, as a result, it has now been found that the above objects are accomplished by providing a photographic layer containing acid-processed gelatin and a matting agent.

The photographic light-sensitive material of this invention comprises a support having at least one photographic layer thereon, and at least one of the photographic layers contains acid-processed gelatin and a matting agent.

DETAILED DESCRIPTION OF THE INVENTION

The photographic layers used herein include a silver halide photographic emulsion layer, a protective layer, a backing layer, an intermediate layer, an antihalation layer, and the like. A particularly preferred embodiment of this invention is a photographic light-sensitive material which comprises a support having thereon at least one silver halide emulsion layer and an uppermost layer coated thereon, the uppermost layer containing acid-processed gelatin and a matting agent.

The term uppermost layer, as used in this invention, means a layer which is a surface layer of those layers constituting the photographic light-sensitive material. A layer such as an intermediate layer or an antihalation layer which does not ultimately form a surface layer can be, in a sense, called an uppermost layer. That is, in preparing the photographic light-sensitive material of this invention, each of the layers may be successively coated on one or more layers, and a layer at the surface in each step can be considered to be an uppermost layer. Moreover, the uppermost layer can be provided on both sides of a support. The thickness of the uppermost layer preferably ranges from about 0.2 to 5$\mu$, particularly 0.5 to 3$\mu$.

The acid-processed gelatin used in this invention is gelatin produced from collagen using a production process including a processing with hydrochloric acid, etc., and differs from alkali-processed gelatin which is generally used in the photographic industry and is produced using a production process including a processing with lime, etc. Details of the processes for producing these gelatins and the properties thereof are described in Arthus Veis, *The Macromolecular Chemistry of Gelatin,* pages 187–217, Academic Press (1964), and the most important difference is that acid-processed gelatin has an isoelectric point of a pH of about 6.0 to 9.5 while alkali-processed gelatin has an isoelectric point of a pH of about 4.5 to 5.3.

It is important in this invention that the uppermost layer contains acid-processed gelatin, but the layers other than the uppermost layer need not necessarily contain acid-processed gelatin. A layer containing acid-processed gelatin can be coated as an uppermost layer of a photographic light-sensitive material having a usual protective layer.

In addition, the objects of this invention are satisfactorily accomplished by additionally incorporating, into an uppermost layer containing, at least, acid-processed gelatin, another hydrophilic binder. Preferred hydrophilic binders which can be used include alkali-processed gelatin, as well as enzyme-processed gelatin produced using a processing with an enzyme in the process of producing gelatin, a so-called gelatin derivative, that is, a product prepared by treating and modifying the functional groups contained in the gelatin molecule, such as amino groups, imino groups, hydroxyl groups or carboxyl groups, with a compound having a group capable of reacting with such a functional group, and a graft polymer prepared by grafting the molecular chain of another high molecular weight material to gelatin.

Compounds which can be used for producing the above-described gelatin derivatives include, e.g., the isocyanates, acid chlorides and acid anhydrides as described in U.S. Pat. No. 2,614,928; the acid anhydrides as described in U.S. Pat. No. 3,118,766; the bromoacetic acids as described in Japanese Patent Publication No. 5,514/64; the phenylglycidyl ethers as described in Japanese Patent Publication No. 21,845/67; the vinylsulfone compounds as described in U.S. Pat. No. 3,132,945; the N-allylvinylsulfonamides as described in British Pat. No. 861,414; the maleinimide compounds as described in U.S. Pat. No. 3,186,846; the acrylonitriles as described in U.S. Pat. No. 2,594,293; the polyalkylene oxides as described in U.S. Pat. No. 3,312,553; the epoxy compounds as described in Japanese Patent Publication No. 26,845/67; the acid esters as described in U.S. Pat. No. 2,763,639; the alkane sultones as described in British Pat. No. 1,033,189; and the like.

Many kinds of chain polymers which can be used for grafting to gelatin are disclosed, for example, in U.S. Pat. Nos. 2,763,625, 2,831,767 and 2,956,884, *Polymer*

*Letters*, 5, 595 (1967), *Photographic Science and Engineering*, 9, 148 (1965), *Journal of Polymer Science*, A-1, 9, 3199 (1971), etc. Furthermore, polymers and copolymers of the so-called vinylic monomers such as acrylic acid, methacrylic acid, derivatives of acrylic acid and derivatives of methacrylic acid such as the esters, amides and nitriles thereof, and styrene can be used for this purpose. Hydrophilic vinylic polymers which are somewhat compatible with gelatin, for example, polymers or copolymers of acrylic acid, acrylamide, methacrylamide, hydroxyalkyl acrylates, hydroxyalkyl methacrylates, etc., are particularly preferred.

In addition, suitable hydrophilic binders include proteins such as colloidal albumin or casein, cellulose derivatives such as carboxymethyl cellulose or hydroxyethyl cellulose, polysaccharides such as agar-agar, sodium alginate, dextran, gum arabic or starch derivatives, and synthetic hydrophilic colloids such as polyvinyl alcohol, poly-N-vinylpyrrolidone, polyacrylic acid copolymer, polymethacrylic acid copolymer, polyacrylamide or polymethacrylamide, derivatives thereof and the partially hydrolyzed products thereof. If desired, a compatible mixture of two or more of these colloids can be used. Of the above-described binders, gelatin derivatives and synthetic high molecular weight materials having carboxyl group or salt thereof are particularly preferred because they have a high controlling effect on the occurrence of reticulation.

There are no particular restrictions on the mixing ratio of acid-processed gelatin and the above-described hydrophilic binder, but in order to obtain the remarkable effects of this invention, the acid-processed gelatin is used in an amount of more than about 20 wt%, particularly more than 40 wt%, based on the total weight of the binders forming the uppermost layer. When the content of the acid-processed gelatin is less than about 20 wt%, and alkali-processed gelatin, enzyme-processed gelatin or a gelatin derivative is not present as the other binders, the coating solution is difficult to set (solidify) by cooling after coating, and it is, thus, difficult to obtain a uniformly and smoothly coated surface.

In particular, the objects of this invention are satisfactorily accomplished by further incorporating a matting agent in an uppermost layer containing, at least, acid-processed gelatin. Matting agents are powders of an organic or inorganic material, and the average particle size thereof is preferably about 0.2 to 10μ, particularly 0.3 to 5μ. Preferred specific examples of matting agents include organic materials such as water-dispersible vinyl polymers such as polymethyl methacrylate, cellulose acetate propionate and starch, etc., and inorganic materials such as silver halide, strontium barium sulfate, calcium carbonate, silicon dioxide, magnesium oxide and titanium oxide, etc. The matting agents described above are incorporated in an uppermost layer containing acid-processed gelatin in an amount of about 1 to 100 mg, preferably 5 to 30 mg, per g of the binder(s).

The use of the matting agent incorporated in the uppermost layer containing acid-processed gelatin provides an adhesion resistance which is remarkably superior to that obtained with the use of the matting agent in combination with alkali-processed gelatin only. This enables a substantial reduction in an amount of the matting agent which needs to be incorporated, so that after processing such photographic light-sensitive materials, images having excellent transparency and graininess can be obtained.

As an additional means for additionally enhancing the effect of this invention, an appropriate amount of a hardening agent or a lubricant can be used together with the binders forming an uppermost layer. It is well known to incorporate these additives for gelatin into an uppermost layer of a conventional photographic light-sensitive material as the means necessary for using the uppermost layer more effectively, and these additives can also be used in this invention for the same purposes. That is, a suitable amount of the hardening agent which can be employed ranges from about 2 to 80 mg, preferably from about 5 to 20 mg, per g of the binders employed in the uppermost layer, and a suitable amount of the lubricant ranges from about 1 to 100 mg, preferably from about 10 to 50 mg, per g of the binders employed in the uppermost layer.

The hardening agents are effective for maintaining the physical strength of a surface layer by moderately hardening an uppermost layer, and specific examples of suitable hardening agents are aldehyde compounds such as formaldehyde or glutaraldehyde; ketone compounds such as diacetyl or cyclopentanedione; compounds containing reactive halogens such as bis(2-chloroethylurea), 2-hydroxy-4,6-dichloro-1,3,5-triazine, compounds as described in U.S. Pat. Nos. 3,288,775 and 2,732,303, and British Pat. Nos. 974,723 and 1,167,207; reactive olefin compounds such as divinyl sulfone, 5-acetyl-1,3-diacryloylhexahydro-1,3,5-triazine or compounds as described in U.S. Pat. Nos. 3,635,718 and 3,232,763, and British Pat. No. 994,869; N-methylol compounds such as N-hydroxymethylphthalimide or compounds as described in U.S. Pat. Nos. 2,732,316 and 2,586,168; isocyanates as described in U.S. Pat. No. 3,103,437; aziridine compounds as described in U.S. Pat. Nos. 3,017,280 and 2,983,611; acid derivatives as described in U.S. Pat. Nos. 2,725,294 and 2,725,295; carbodiimide compounds as described in U.S. Pat. No. 3,100,704; epoxy compounds as described in U.S. Pat. No. 3,091,537; isooxazole compounds as described in U.S. Pat. Nos. 3,321,313 and 3,543,292; halocarboxyaldehydes such as mucochloric acid; dioxane derivatives such as dihydroxydioxane or dichlorodioxane; and inorganic hardening agents such as chrome alum or zirconium sulfate. Moreover, in place of the above compounds, hardening agent precursors such as alkali metal bisulfite-aldehyde adducts, methylol derivatives of hydantoin or primary aliphatic nitroalcohols can be used.

Lubricants are useful for preventing adhesion due to an effect similar to that exhibited by the matting agents, and also are effective for improving the friction characteristics, particularly in the compatibility with a camera on photographing or on projection of movie films. Specific examples of preferred lubricants which can be used include waxes such as liquid paraffin and esters of higher aliphatic acids, polyfluorinated hydrocarbons and derivatives thereof, and silicones such as polyalkyl polysiloxanes, polyaryl polysiloxanes and polyalkylaryl polysiloxanes, and the alkylene oxide addition derivatives thereof.

Surface active agents can also be added, individually or as a mixture thereof, e.g., in an amount of from about 0.5 to 50 mg, preferably 1 to 20 mg, per g of the binders employed, to a dispersion used for forming an uppermost layer. They are generally used as a coating aid for preventing the occurrence of difficulties such as unevenness in coating, but they are sometimes employed for other purposes, for example, for improving emulsification and dispersion, for preventing the formation of static charges and adhesion to a finished light-sensitive material, or the like. These surface active agents can be classified as natural surface active agents such as saponin; nonionic surface active agents such as alkylene oxide, glycerol or glycidol nonionic surface active agents; cationic surface active agents such as higher alkylamines, quaternary ammonium salts, pyridinium or other heterocyclic onium salts, phosphoniums or sulfoniums; anionic surface active agents containing acid groups such as carboxylic acid, sulfonic acid, phosphoric acid, sulfuric ester or phosphoric ester groups; and amphoteric surface active agents such as amino acids, aminosulfonic acids, or sulfuric or phosphoric esters of aminoalcohols.

The surface active agents which can be used are described, e.g., in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, German Patent Application (OLS) No. 1,942,665 and British Pat. Nos. 1,077,317 and 1,198,450, as well as in Ryohei Oda et al., *Synthesis and Applications of Surface Active Agents,* Maki Publisher (1964), A. M. Schwartz et al., *Surface Active Agents,* Interscience Publications In. (1958), and J. P. Sisley et al., *Encyclopedia of Surface Active Agents,* Vol. 2, Chemical Publishing Company (1964).

The photographic light-sensitive materials of this invention can contain the following components and can be prepared by the production methods described below.

Silver halide emulsions are usually prepared by mixing a solution of a water-soluble silver salt (such as silver nitrate) with a solution of a water-soluble halide (such as potassium bromide) in the presence of a solution of a water-soluble high molecular weight material such as gelatin. Silver halides which can be used include silver chloride, silver bromide, as well as mixed silver halides such as silver chlorobromide, silver bromoiodide or silver chlorobromoiodide. The silver halide grains can be prepared using conventional methods. Of course, the grains can be advantageously prepared using the so-called single or double jet method, controlled double jet method, and the like. Moreover, two or more of silver halide photographic emulsions, separately prepared, can be mixed, if desired.

The crystal structure of the silver halide grains can be uniform throughout the grain, can have a stratified structure in which the interior and outer portion are different, or can be of the so-called conversion type as described in British Pat. No. 635,841 and U.S. Pat. No. 622,318. In addition, the silver halides can be of the type in which a latent image is formed mainly on the surface of the grains or of the type in which a latent image is formed in the interior of the grains thereof.

The above photographic emulsions are described, e.g., in C. E. K. Mees & T. H. James, *The Theory of the Photographic Process,* 3rd Ed., Macmillan, New York (1966); P. Grafkides, *Chimie Photographique,* Paul Montel, Paris (1957); etc., and can be prepared using various methods which are usually employed such as an ammonia process, a neutral process or an acid process.

The silver halide grains are, after the formation thereof, washed with water to remove the water-soluble salts produced as by-products (for example, potassium nitrate when silver bromide is prepared using silver nitrate and potassium bromide) from the system and then heat treated in the presence of a chemical sensitizer such as sodium thiosulfate, N,N,N'-trimethylthiourea, gold(I) thiocyanate complex, gold(I) thiosulfate complex, stannous chloride or hexamethylenetetramine to increase the sensitivity without coarsening the grains. Conventional sensitizing methods are described in Mees and James, supra, and Grafkides, supra.

Hydrophilic colloids which can be used as a vehicle for silver halide include gelatin, colloidal albumin, casein, cellulose derivatives such as carboxymethyl cellulose or hydroxyethyl cellulose, polysaccharides such as agar-agar, sodium alginate or starch derivatives, and synthetic hydrophilic colloids such as polyvinyl alcohol, poly-N-vinylpyrrolidone, polyacrylic acid copolymers or polyacrylamide, and the derivatives thereof and the partially hydrolyzed products thereof. If desired, a compatible mixture of two or more of these hydrophilic colloids can be used. Of the above-described hydrophilic colloids, gelatin is most generally used, but gelatin can be, partially or completely, replaced with a synthetic high molecular weight material. Furthermore, the gelatin can be replaced with a so-called gelatin derivative, i.e., a product prepared by treating or modifying the functional groups contained in the gelatin molecule such as amino groups, imino groups, hydroxy groups or carboxyl groups with a compound having a group capable of reacting with such a functional group, or a graft polymer prepared by grafting the molecular chain of another high molecular weight material to gelatin.

Compounds for producing the above gelatin derivatives include, e.g., isocyanates, acid chlorides and acid anhydrides as described in U.S. Pat. No. 2,614,928; acid anhydrides as described in U.S. Pat. No. 3,118,766; bromoacetic acids as described in Japanese Patent Publication No. 5,514/64; phenylglycidyl ethers as described in Japanese Patent Publication No. 26,845/67; vinylsulfone compounds as described in U.S. Pat. No. 3,132,945; N-allylvinylsulfonamides as described in British Pat. No. 861,414; maleinimide compounds as described in U.S. Pat. No. 3,186,846; acrylonitriles as described in U.S. Pat. No. 2,594,293; polyalkylene oxides as described in U.S. Pat. No. 3,312,553; epoxy compounds as described in Japanese Patent Publication No. 26,845/67; acid esters as described in U.S. Pat. No. 2,763,639; alkane sultones as described in British Pat. No. 1,033,189; and the like.

Chain polymers which can be used for grafting to gelatin are disclosed, for example, in U.S. Pat. Nos. 2,763,625, 2,831,767 and 2,956,884, *Polymer Letters,* 5, 595 (1967), *Photographic Science and Engineering,* 9, 148 (1965), *Journal of the Polymer Science,* A-1, 9, 3199 (1971), etc. Furthermore, polymers and copolymers of the so-called vinylic monomers such as acrylic acid, methacrylic acid, derivatives of acrylic acid and methacrylic acid such as the esters, amides and nitriles thereof, and styrene can be used for this purpose. Hydrophilic vinyl polymers which are somewhat compatible with gelatin, for example, polymers or copolymers of acrylic acid, acrylamide, methacrylamide, hydroxyalkyl acrylates, hydroxyalkyl methacrylates, etc., are particularly preferred.

In the photographic emulsion layer and other layers which are used in this invention, synthetic polymer compounds such as a latex of water-dispersible vinyl compound polymers, particularly, compounds increasing the dimensional stability of the photographic material can be incorporated as such or as a mixture (e.g., of different polymers), or in combination with hydrophilic colloids which are permeable to water. Many such polymers are known, and are described, e.g., in U.S. Pat. Nos. 2,375,005, 2,739,137, 2,853,457, 3,062,674, 3,411,911, 3,488,708, 3,525,620, 3,635,715, 3,607,290 and 3,645,740, British Pat. Nos. 1,186,699 and 1,307,373, etc. Of these polymers, copolymers or homopolymers of alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxy methacrylates, styrene, butadiene, vinyl chloride, vinylidene chloride, maleic anhydride and itaconic anhydride are generally used. If desired, the so-called graft-type emulsion-polymerized latices of these vinyl compounds which are prepared by subjecting such a vinyl compound to emulsion polymerization in the presence of a hydrophilic protective colloid high molecular weight material can be used.

The above silver halide emulsions can be chemically sensitized in a conventional manner. Suitable chemical sensitizers include, e.g., gold compounds such as chloroaurate or auric trichloride as described in U.S. Pat. Nos. 2,399,083, 2,540,085, 2,597,856 and 2,597,915; salts of noble metals such as platinum, palladium, iridium, rhodium or ruthenium as described in U.S. Pat. Nos. 2,448,060, 2,540,086, 2,566,245, 2,566,263 and 2,598,079; sulfur compounds capable of forming silver sulfide by reacting with a silver salt as described in U.S. Pat. Nos. 1,574,944, 2,410,689, 3,189,458 and 3,501,313; stannous salts as described in U.S. Pat. Nos. 2,487,850, 2,518,698, 2,521,925, 2,521,926, 2,694,637, 2,983,610 and 3,201,254; amines; and other reducing compounds.

Various compounds can be added to the above photographic emulsions in order to prevent a reduction in sensitivity and the occurrence of fog during production of the light-sensitive material, during storage, and during processing. Many such compounds are well known, for example, 4-hydroxy-6-methyl-1,3,3*a*, 7-tetraazaindene, 3-methylbenzothiazole, 1-phenyl-5-mercaptotetrazole, as well as a large number of heterocyclic compounds, mercury-containing compounds, mercapto compounds, metal salts, and the like. Examples of such compounds which can be used are described in C.E.K. Mees & T.H. James, supra and the original references cited therein, and also in the following patents: U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339 and British Pat. Nos. 893,428, 403,789, 1,173,609 and 1,200,188.

The photographic emulsion can be, if desired, spectrally sensitized or supersensitized using cyanine dyes such as cyanine, merocyanine or carbocyanine individually or in admixture, or in combination with, e.g., styryl dyes. Such color sensitization techniques are well known and are described, e.g., in U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, German Patent Application (OLS) Nos. 2,030,326 and 2,121,780, Japanese Patent Publication Nos. 4,936/68, 14,030/69 and 10,773/68, U.S. Pat. Nos. 3,511,664, 3,522,052, 3,527,641, 3,615,613, 3,615,632, 3,617,395, 3,635,721 and 3,694,217, and British Pat. Nos. 1,137,580 and 1,216,203. The techniques can be optionally selected depending upon the purpose and end-use of the light-sensitive material, that is, the wavelength region to be sensitized, the sensitivity desired, and the like.

In the photographic light-sensitive material of this invention containing a coupler, a so-called diffusion-resistant coupler is present in the silver halide emulsion layer. Examples of suitable couplers are 4-equivalent or 2-equivalent diketomethylene yellow forming couplers such as the compounds as described in U.S. Pat. Nos. 3,415,625, 3,447,928, 3,311,476 and 3,408,194, the compounds as described in U.S. Pat. Nos. 2,875,057, 3,265,506, 3,409,439, 3,551,155 and 3,551,156, and the compounds as described in Japanese Patent Application (OPI) Nos. 26,133/72 and 66,836/73; 4-equivalent or 2-equivalent pyrazolone magenta forming couplers or indazolone magenta forming couplers such as the compounds as described in U.S. Pat. Nos. 2,600,788, 2,983,608, 3,062,653, 3,214,437, 3,253,924, 3,419,391, 3,419,808, 3,476,560 and 3,582,322, Japanese Patent Publication No. 20,636/70, and Japanese Patent Application (OPI) No. 26,133/72; α-naphthol or phenol cyan forming couplers such as the compounds as described in U.S. Pat. Nos. 2,474,293, 2,698,794, 3,034,892, 3,214,437, 3,253,924, 3,311,476, 3,458,315 and 3,591,383, and Japanese Patent Publication Nos. 11,304/67 and 32,461/69. Moreover, the DIR couplers as described in U.S. Pat. Nos. 3,227,554, 3,297,445, 3,253,924, 3,311,476, 3,379,529, 3,516,831, 3,617,291 and 3,705,801, and German Patent Application (OLS) No. 2,163,811 can be used.

The silver halide emulsion can contain a dye-developing agent or a dye which can be bleached, and also can contain an ultraviolet absorbent, a fluorescent brightener, a dye for antihalation or filtering, etc.

The photographic layers of this invention can be hardened using conventional procedures. Examples of suitable hardening agents include aldehyde compounds such as formaldehyde or glutaraldehyde; ketone compounds such as diacetyl or cyclopentanedione; compounds having reactive halogens such as bis (2-chloroethylurea), 2-hydroxy-4,6-dichloro-1,3,5-triazine or those as described in U.S. Pat. Nos. 3,288,775 and 2,732,303, and British Pat. Nos. 974,723 and 1,167,207; reactive olefin compounds such as divinyl sulfone, 5-acetyl-1,3-diacryloylhexahydro-1,3,5-triazine, or those as described in U.S. Pat. Nos. 3,635,718 and 3,232,763, and British Pat. No. 994,869; N-methylol compounds such as N-hydroxymethylphthalimide, or those as described in U.S. Pat. Nos. 2,732,316 and 2,586,168; isocyanates as described in U.S. Pat. No. 3,103,437; aziridine compounds as described in U.S. Pat. Nos. 3,017,280 and 2,983,611; acid derivatives as described in U.S. Pat. Nos. 2,725,294 and 2,725,295; carbodiimide compounds as described in U.S. Pat. No. 3,100,704; epoxy compounds as described in U.S. Pat. No. 3,091,537; isooxazole compounds as described in U.S. Pat. Nos. 3,321,313 and 3,543,292; halocarboxyaldehydes such as mucochloric acid; dioxane derivatives such as dihydroxydioxane or dichlorodioxane; and inorganic hardening agents such as chrome alum or zirconium sulfate. Moreover, in place of the above compounds, hardening agent precursors such as alkali metal bisulfite-aldehyde adducts, methylol derivatives of hydantoin or primary aliphatic nitroalcohols can be used.

The photographic layer of this invention can contain surface active agents, individually or in admixture. They are generally used as a coating aid, but they are sometimes employed for other purposes, for example, for improving emulsification and dispersion, sensitization or photographic characteristics, for prevention of the generation of static charges or adhesion, etc. These surface active agents can be classified into natural surface active agents such as saponin; nonionic surface active agents such as alkylene oxide, glycerol or glycidol nonionic surfactants; cationic surface active agents such as higher alkylamines, quaternary ammonium salts, pyridines or other heterocyclic onium salts, phosphoniums or sulfoniums; anionic surface active agents containing acid groups such as carboxylic acid, sulfonic acid, phosphoric acid, sulfuric ester or phosphoric ester groups; and amphoteric surface active agents such as amino acids, aminosulfonic acids, or sulfuric or phosphoric esters of aminoalcohols. The surface active agents which can be used are described, e.g., in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, German Patent Application (OLS) No. 1,942,665 and British Pat. Nos. 1,077,317 and 1,198,450, as well as Ryohei Oda et al., *Synthesis and Applications of Surface Active Agents,* Maki Publisher (1964), A.M. Schwartz, et al., *Surface Active Agents,* Interscience Publications Inc. (1958), and J.P. Sisley et al., *Encyclopedia of Surface Active Agents,* Vol. 2, Chemical Publishing Company (1964).

The photographic emulsion layers and/or a backing layer can be coated, in this invention, on a support of such a substantially planar material which undergoes no marked changes in size during the course of processing. The layers are coated, for example, on a rigid support such as glass, metal or ceramics or a flexible support depending upon the end-use purpose. Typical examples of flexible supports are those which are generally used for photographic light-sensitive materials, such as cellulose nitrate films, cellulose acetate films, cellulose acetate butyrate films, cellulose acetate propionate films, polystyrene films, polyethylene terephthalate films, polycarbonate films, laminates of these films, thin glass films, and papers. Moreover, good results are also obtained with supports such as papers coated or laminated with baryta or a polymer of an $\alpha$-olefin, particularly having 2 to 10 carbon atoms, for example, polyethylene, polypropylene, ethylene-butene copolymers, etc., or synthetic resin films as described in Japanese Patent Publication No. 19,068/72 the surface of which has been roughened to improve the adhesion to other high molecular weight materials and improve printability.

The supports can be transparent or opaque depending upon the end-use purpose of the light-sensitive material. The transparent supports can be colorless or can be colored with a dye or a pigment. Colored transparent supports have hitherto been employed in X-ray films and are described, e.g., in *J. SMPTE,* 67, 296 (1958).

Suitable opaque supports include those which are intrinsically opaque, for example, papers, as well as films prepared by adding a dye or a pigment such as titanium oxide to a transparent film, synthetic resin films the surface of which has been treated in the manner as described in Japanese Patent Publication No. 19,068/72, and papers or synthetic resin films which are rendered completely light-shielding by the addition of carbon black, a dye, etc. If the adhesion between the support and the photographic emulsion layer is insufficient, a layer having good adhesion to both of these elements can be employed as a subbing layer. For further improving the adhesive property of the support, the surface of the support can be subjected to a pre-treatment such as a corona discharge, an ultraviolet irradiation, a flame treatment, and the like.

The photographic layers of the photographic light-sensitive material can be coated using various coating methods including dip coating, air-knife coating, curtain coating, and extrusion coating using a hopper as described in U.S. Pat. No. 2,681,294. If desired, two or more layers can be coated at the same time using the techniques as described in U.S. Pat. Nos. 2,761,791, 3,508,947, 2,941,898 and 3,526,528.

The photographic light-sensitive material of this invention has, essentially, a photographic layer containing acid-processed gelatin and a matting agent, and the remaining structure can be arranged in a conventional manner. For example, the material can have a single emulsion layer or a number of emulsion layers, and can contain an intermediate layer, a filter layer, a subbing layer, an antihalation layer, etc. Therefore, the photographic light-sensitive material of this invention includes all types of photographic light-sensitive materials such as light-sensitive materials for black-and-white photography (for example, black-and-white photographic films, photographic papers, infrared films, X-ray films, lithographic films, dry plates, etc. and light-sensitive materials for color photography (for example, color positive films, color papers, color negative films, color reversal films, etc.).

The black-and-white light-sensitive material of this invention can be developed using conventional techniques. Developing agents which can be used include: 4-aminophenols such as 4-N-methyl-aminophenol hemisulfate (metol), 4-N-benzyl-aminophenol hydrochloride, 4-N,N-diethyl-aminophenol hydrochloride, 4-aminophenol sulfate, etc.; 3-pyrazolidones such as 1-phenyl-3-pyrazolidone, 4-dimethyl-1-phenyl-3-pyrazolidone or 4-methyl-1-phenyl-3-pyrazolidone; polyhydroxybenzenes such as hydroquinone, 2-methylhydroquinone, 2-phenylhydroquinone, 2-chlorohydroquinone, pyrogallol or catechol; p-phenylenediamines such as p-phenylenediamine hydrochloride or N,N-diethyl-p-phenylenediamine sulfate; ascorbic acid, N-(p-hydroxyphenyl)glycine, as well as those compounds described as developing agents in C. E. K. Mees & T. H. James. supra, Chapter 13, and L. F. A. Mason, *Photographic Processing Chemistry,* pages 16–30, Oxford Press (1966). The above developing agents can be used individually or as a mixture thereof and in appropriate combination with other compounds.

Typical examples of such other compounds include alkali agents such as the hydroxides, carbonates or phosphates of alkali metals or ammonia; pH modifiers or buffers, for example, weak acids such as acetic acid or boric acid, weak bases, or the salts thereof; development accelerators, for example, various pyridinium compounds, cationic compounds, potassium nitrate and sodium nitrate as described in U.S. Pat. Nos. 2,648,604 and 3,671,247, polyethylene glycol condensates and derivatives thereof as described in U.S. Pat. Nos. 2,533,990, 2,577,127 and 2,950,970, nonionic compounds such as polythioethers of which the compounds as described in British Pat. Nos. 1,020,033 and 1,020,032 are representative, organic amines such as pyridine or ethanolamine, benzyl alcohol, hydrazines, etc.; antifogging agents, for example, alkali metal bromides, alkali metal iodides, nitrobenzimidazoles as described in U.S. Pat. Nos. 2,496,940 and 2,656,271, as well as mercaptobenzimidazole, 5-methylbenztriazole, 1-phenyl-5-mercaptotetrazole, compounds for rapid processing as described in U.S. Pat. Nos. 3,113,864, 3,342,596, 3,295,976, 3,615,522 and 3,597,119, thiosulfonyl compounds as described in British Pat. No. 972,211, phenazine-N-oxides as described in Japanese Patent Publication No. 41,675/71, antifogging agents as described in *Manual of Scientific Photography,* Vol. 2, pages 29–47, etc.; stain- or sludge-preventing agents as described in U.S. Pat. Nos. 3,161,513 and 3,161,514, and British Pat. Nos. 1,030,442, 1,144,481 and 1,251,558; and antioxidants such as sulfites, bisulfites, hydroxylamine hydrochloride, formsulfite or alkanolamine-sulfite adducts.

The development can be followed by stopping, fixing and stabilizing. Development and the subsequent steps can be effected at a temperature below about 20° C., or higher temperatures, and, if desired, at above about 30° C., and preferably at about 32° to 60° C. In these cases, all of the steps need not always be effected at the same temperature.

The light-sensitive materials for color photography of this invention are developed, after exposure, to form color images. Development processing basically includes at least one color development step and, optionally, a pre-hardening step, a neutralizing step, a first development (black-and-white development) step, etc. The above steps and the subsequent steps (for example, a combination of bleaching, fixing, bleach-fixing, stabilizing, washing, etc.) can be effected at a temperature below about 20° C., or higher temperatures, and, if desired, at above about 30° C., and preferably at about 32° to 60° C. Again, the steps need not always be effected at the same temperature, and they can be carried out at higher or lower temperatures.

Color developers are alkaline aqueous solutions containing a compound whose oxidized product reacts with a color coupler to form a dye, that is, containing, as a developing agent, p-phenylenediamines such as N,N-diethyl-p-phenylenediamine, N,N-diethy-3-methyl-p-phenylenediamine, 4-amino-3-methyl-N-ethyl-N-methanesulfonamidoethylaniline, 4-amino-3-methyl-N-ethyl-N-β-hydroxyethylaniline and N-ethyl-N-β-hydroxyethyl-p-phenylenediamine, or salts thereof such as the hydrochlorides, sulfates and sulfites thereof. The alkaline aqueous solution has a pH higher than about 8, preferably from 9 to 12. The compounds as described in U.S. Pat. Nos. 2,193,015 and 2,592,364, and Japanese Patent Application (OPI) No. 64,933/73 can also been used as a developing agent. The color developers can contain, in addition to the above developing agent, a salt such as sodium sulfate; a pH modifier such as sodium hydroxide, sodium carbonate or sodium phosphate; a buffer, for example, an acid such as acetic acid or boric acid, or a salt thereof; and a development accelerator, for example, various pyridinium compounds, cationic compounds, potassium nitrate and sodium nitrate as described in U.S. Pat. Nos. 2,648,604 and 3,671,247, polyethylene glycol condensates and the derivatives thereof as described in U.S. Pat. Nos. 2,533,990, 2,577,127 and 2,950,970, nonionic compounds such as polythioethers represented by the compounds as described in British Pat. Nos. 1,020,033 and 1,020,032, polymer compounds containing sulfite ester groups represented by the compounds as described in U.S. Pat. No. 3,068,097, as well as organic amines such as pyridine or ethanolamine, benzyl alcohol, hydrazines, etc. Moreover, the color developers can contain an antifogging agent, for example, alkali metal bromides, alkali metal iodides, nitrobenzimidazoles as described in U.S. Pat. Nos. 2,496,940 and 2,656,271, as well as mercaptobenzimidazole, 5-methylbenztriazole, 1-phenyl-5-mercaptotetrazole, compounds for rapid processing as described in U.S. Pat. Nos. 3,113,864, 3,342,596, 3,295,976, 3,615,522 and 3,597,199, thiosulfonyl compounds as described in British Pat. No. 972,211, phenazine-N-oxides as described in Japanese Patent Publication No. 41,675/71, antifogging agents as described in *Manual of Scientific Photography,* Vol. 2, pages 29–47, etc.; a stain- or sludge-preventing agent as described in U.S. Pat. Nos. 3,161,513 and 3,161,514, and British Pat. Nos. 1,030,442, 1,144,481 and 1,251,558; an agent for accelerating the interimage effect as described in U.S. Pat. No. 3,536,487; and an antioxidant such as a sulfite, hydrogen sulfite, hydroxylamine hydrochloride or formaldehyde-alkanolamine sulfite adducts.

The developers can contain a diffusible yellow forming coupler as described in U.S. Pat. Nos. 3,510,306 and 3,619,189 and Japanese Patent Publication Nos. 33,775/65 and 3,664/69; a diffusible magenta forming coupler as described in German Patent Application (OLS) No. 2,016,587, U.S. Pat. Nos. 2,369,489, 2,600,788, 3,152,896 and 3,615,502, and Japanese Patent Publication No. 13,111/69; and a diffusible cyan forming coupler as described in U.S. Pat. Nos. 3,002,836 and 3,542,552, and British Patent No. 1,062,190.

The light-sensitive material for color photography of this invention can also be subjected to processings prior to color development.

Usually a prehardening bath is used as a processing solution prior to the development step. An aqueous solution containing one or more aldehydes is generally used as a prehardening bath. Aldehydes have the effect of reacting with gelatin, that is one of the components of the photographic emulsion, thereby to harden the same. Suitable aldehydes include aliphatic aldehydes (formaldehyde, glyoxal, succinaldehyde, glutaraldehyde, pyruvic aldehyde, etc.) as described in U.S. Pat. No. 3,232,761, and aromatic aldehydes as described in U.S. Pat. Nos. 3,565,632 and 3,677,760. The aqueous solution can contain an inorganic salt such as sodium sulfate, a pH modifier or a buffer such as borax, boric acid, acetic acid, sodium acetate, sodium hydroxide or sulfuric acid, and a development fog inhibitor, for example, an alkali metal halide such as potassium bromide.

In general, a neutralizing bath is provided for the purpose of preventing the aldehydes used in the prehardening step from being carried over into the development bath. The neutralizing bath contains an agent for removing aldehydes, for example, hydroxylamine, l-ascorbic acid, etc., and also contains an inorganic salt, a pH modifier or a buffer.

Developers for color reversal films are also used prior to color development. For this purpose, an alkaline aqueous solution containing one or more of developing agents such as hydroquinone, 1-phenyl-3-pyrazolidone or N-methyl-p-aminophenol is used. The alkaline aqueous solution also can contain an inorganic salt such as sodium sulfate, a pH adjusting agent or a buffer such as borax, boric acid, sodium hydroxide or sodium carbonate, and a development fog inhibitor, for example, an alkali metal halide such as potassium bromide.

All of the additives exemplified for each of the processing steps described above and the amount thereof employed are well known in the art of color photographic processing methods.

After color development, the color photographic materials are usually bleached and fixed. Bleach and fixation can be combined and, thus, a bleach-fix bath can be used. Many compounds can be used as a bleaching agent, but of these compounds, generally ferricyanide salts, dichromate salts, water-soluble iron (III) salts, water-soluble cobalt (III) salts, water-soluble copper (II) salts, water-soluble quinones, nitrosophenols, complex salts of an organic acid and a polyvalent cation such as iron (III), cobalt (III) or copper (II) (for example, metal complex salts of aminopolycarboxylic acids such as ethylenediaminetetraacetic acid, nitrilotriacetic acid, iminodiacetic acid or N-hydroxyethylethylenediaminetriacetic acid, malonic acid, tartaric acid, malic acid, diglycolic acid, or dithioglycolid acid, 2,6-dipicolinic acid copper complex salt, etc.), peroxy acids such a alkyl peroxy acids, persulfate salts, permanganate salts or hydrogen peroxide, hydrochlorides, chlorine, bromine, etc., are used, either individually or in an appropriate combination. In addition, bleach accelerators as described in U.S. Pat. Nos. 3,042,520 and 3,241,966, and Japanese Patent Publication Nos. 8,506/70 and 8,836/70, and the like can also be employed.

In the fixation step, any known fixing solutions can be used. For example, ammonium thiosulfate, sodium thiosulfate or potassium thiosulfate can be used as a fixing agent in an amount of about 50 to 200 g/liter and, in addition, a stabilizing agent such as sulfite salts or metabisulfite salts, a hardening agent such as potassium alum, a pH buffer such as acetate salts or borate salts, and the like can be present in the fixing solution. The fixing solutions have a pH of about 3 to 12, generally a pH of about 3 to 8.

Suitable bleaching agents, fixing agents and bleach-fix baths are described, e.g., in U.S. Pat. No. 3,582,322.

Image-stabilizing baths can also be employed according to the techniques as described in U.S. Pat. Nos. 2,515,121, 2,518,686 and 3,140,177.

The invention is further explained by reference to the following examples. Unless otherwise indicated herein, all parts, percents, ratios and the like are by weight.

EXAMPLE 1

A red-sensitive silver halide emulsion layer, an intermediate layer, a green-sensitive silver halide emulsion layer, a yellow filter layer and a blue-sensitive silver halide emulsion layer, each containing the additives shown in Table 2 below, and an uppermost layer, were coated in that order on an undercoated cellulose triacetate support, thus preparing Samples 1 to 6.

An alkali-processed gelatin having an isoelectric point of a pH of 4.9 was used as a binder for each layer except the uppermost layer. As binders for the uppermost layer, acid-processed gelatin having an isoelectric point of a pH of 9.0 or alkali-processed gelatin having an isoelectric point of a pH of 4.9, benzenesulfonyl chloride-processed gelatin or phenylisocyanate-processed gelatin as a gelatin derivative, and styrene-sodium maleate copolymer or acrylonitrile-sodium acrylate copolymer as a synthetic high molecular weight material containing carboxyl groups or the salts thereof as a binder for each layer for except the uppermost layer were used in the ratio (% by weight) shown in Table 1 below.

TABLE 1

| | Binder | | | | | |
|---|---|---|---|---|---|---|
| Sample | Acid-Processed Gelatin (%) | Alkali-Processed Gelatin (%) | Benzenesulfonyl Chloride-Processed Gelatin (%) | Phenylisocyanate-Processed Gelatin (%) | Styrene-Sodium Maleate Copolymer (%) | Acrylonitrile-Sodium Acrylate Copolymer (%) |
| 1 | 100 | 0 | 0 | 0 | 0 | 0 |
| 2 | 60 | 0 | 40 | 0 | 0 | 0 |
| 3 | 60 | 0 | 0 | 40 | 0 | 0 |
| 4 | 60 | 0 | 0 | 0 | 40 | 0 |
| 5 | 60 | 0 | 0 | 0 | 0 | 40 |
| 6 | 0 | 100 | 0 | 0 | 0 | 0 |

TABLE 2

| Component | Red-Sensitive Silver Halide Emulsion Layer | Green-Sensitive Silver Halide Emulsion Layer | Blue-Sensitive Silver Halide Emulsion Layer | Intermediate Layer | Yellow Filter Layer |
|---|---|---|---|---|---|
| Coupler | 4-Chloro-1-hydroxy-N-dodecyl-2-naphthamide (0.88 g/m$^2$) | 1-(2,4,6-Trichlorophenyl)-3-[3-(2,4-di-t-amylphenoxy)-acetamido] benzamido-5-pyrazolone (0.75 g/m$^2$) | 3'-(2,4-Di-t-amylphenoxyacetamido)-α-(4-methoxybenzoyl)-acetanilide (1.31 g/m$^2$) | — | — |
| Spectral Sensitizer | bis(9-Ethyl-5-chloro-3-β-hydroxyethyl)-thiacarbocyanine bromide (6.51 mg/m$^2$) | bis(9-Ethyl-5-phenyl-3-ethyl)oxycarbocyanine isothiocyanate (5.23 mg/m$^2$) | — | — | — |
| Stabilizing[1] Agent | (8.19 mg/m$^2$) | (7.71 mg/m$^2$) | (6.50 mg/m$^2$) | — | — |
| Hardening[2] Agent | (15 mg/m$^2$) | (14 mg/m$^2$) | (20 mg/m$^2$) | (10 mg/m$^2$) | (11 mg/m$^2$) |
| Coating Aid[3] | (42 mg/m$^2$) | (51 mg/m$^2$) | (67 mg/m$^2$) | (56 mg/m$^2$) | (63 mg/m$^2$) |
| [4] | (53 mg/m$^2$) | (64 mg/m$^2$) | (84 mg/m$^2$) | (71 mg/m$^2$) | (80 mg/m$^2$) |
| Silver Halide/ Colloidal Silver | Silver halide emulsion: silver bromoiodide emulsion (silver iodide: 5.5 mol %) | | | — | Yellow colloidal silver |
| Dry Film | 5 μ | 6 μ | 5 μ | 2 μ | 2 μ |

TABLE 2-continued

| Component | Red-Sensitive Silver Halide Emulsion Layer | Green-Sensitive Silver Halide Emulsion Layer | Blue-Sensitive Silver Halide Emulsion Layer | Intermediate Layer | Yellow Filter Layer |
|---|---|---|---|---|---|
| Thickness | | | | | |

(1)5-Hydroxy-7-methyl-1,3,8-triazaindolizine
(2)2,4-Dichloro-6-hydroxy-1,3,5-triazine sodium salt
(3)Sodium p-dodecylbenzenesulfonate
(4)Sodium p-nonylphenoxypoly(ethyleneoxy)propanesulfonate For the uppermost layer for each of the samples, 20 mg of polymethyl methacrylate having an average particle size of 2.1μ as a matting agent and 8 mg of 2,4-dichloro-6-hydroxy-1,3,5-triazine sodium salt as a hardening agent were used per g of binder. The uppermost layer was coated to provide a film thickness of 1.5μ on a dry basis and dried at a temperature of 25° C. and a relative humidity of 50%.

These samples were kept under the conditions of 25° C. and a relative humidity of 60% for one week, and then subjected to the following color negative processing. After the processing, reticulation of each of the samples was evaluated. The processing temperature was maintained at 25°, 30° or 38° C.

| Processing Steps | |
|---|---|
| Color Development | 3 minutes |
| Bleaching | 6 minutes |
| Washing | 3 minutes |
| Fixing | 6 minutes |
| Washing | 3 minutes |
| Stabilizing Bath | 3 minutes |

The processing baths employed had the following composition.

| | |
|---|---|
| Color Developer | |
| Sodium Sulfate | 2.0 g |
| Sodium Carbonate (monohydrate) | 30.0 g |
| Potassium Bromide | 2.0 g |
| Benzyl Alcohol | 5.0 ml |
| Hydroxylamine Sulfate | 1.6 g |
| 4-Amino-3-methyl-N-ethyl-N-(β-hydroxyethyl)aniline | 4.0 g |
| Water to make | 1 l |
| Bleaching Solution | |
| Iron-Sodium Ethylenediaminetetraacetate | 100.0 g |
| Potassium Bromide | 60.0 g |
| Ammonium Hydroxide (28% aq. soln.) | 50.0 ml |
| Glacial Acetic Acid | 25.0 ml |
| Water to make | 1 l |
| Fixing Solution | |
| Sodium Sulfate | 10.0 g |
| Sodium Thiosulfate | 200.0 g |
| Water to make | 1 l |
| Stabilizing Bath | |
| Formalin (40%) | 10.0 g |
| Water to make | 1 l |

In testing adhesion, the samples were cut into 4 cm square pieces. For moisture conditioning, the pieces were placed, in a manner such that they did not overlap each other, in a container kept at a temperature of 30° C. and a relative humidity of 90% for 2 days. After the moisture conditioning, the uppermost layer of one light-sensitive layer and the backing layer of another light-sensitive layer were superimposed, and then the assembly was kept for 24 hours with weight of 50 g/cm$^2$ being placed thereon to further moisture condition. Then, these samples were peeled off, and the adhered area was measured, the ratio of the adhered portions being determined as a percentage. The results of reticulation and adhesion of Samples 1 to 6 are shown in Table 3 below.

TABLE 3

| Sample | Reticulation Processing Temperature 25° C. | 30° C. | 38° C. | Adhered Area (%) |
|---|---|---|---|---|
| 1 | A | A | B | 15 |
| 2 | A | A | A | 15 |
| 3 | A | A | A | 20 |
| 4 | A | A | A | 15 |
| 5 | A | A | A | 20 |
| 6 | B | C | D | 85 |

In Table 3 above, the grades A, B, C and D have the following meaning.

A: Reticulation was not observed at all on microscopic observation at a magnification of 50 times.

B. Slight reticulation was observed on microscopic observation at a magnification of 50 times.

C: Marked reticulation was observed on microscopic observation at a magnification of 50 times.

D: Reticulation was markedly observed with unaided visual examination.

It is apparent from the results in Table 3 above that the use of acid-processed gelatin provides less reticulation as compared with the case of using alkali-processed gelatin (particularly, there is a significant difference at above 30° C.), and provides smaller areas of adhesion which show excellent adhesion resistance. Moreover, it can be seen that when acid-processed gelatin is used in combination with a gelatin derivative or a high molecular weight material containing a carboxyl group or a salt thereof in the uppermost layer, the occurrence of reticulation is remarkably controlled.

EXAMPLE 2

A red-sensitive silver halide emulsion layer, an intermediate layer, a green-sensitive silver halide emulsion layer and a yellow filter layer were coated in that order on an undercoated cellulose triacetate support in the same manner as in Example 1 except that 1,3,5-triacryloylperhydro-1,3,5-triazine was used as a hardening agent, and the amount thereof was 46 mg/m$^2$ for the red-sensitive silver halide emulsion layer, 43 mg/m$^2$ for the green-sensitive silver halide emulsion layer, 62 mg/m$^2$ for the blue-sensitive silver halide emulsion layer and 32 mg/m$^2$ for the intermediate layer. Then, the same blue-sensitive layer as described in Example 1 except that 20% of the entire gelatin was replaced with acid-processed gelatin having an isoelectric point of a pH of 6.5 was coated as a blue-sensitive emulsion layer. For an uppermost layer, acid-processed gelatin having an isoelectric point of a pH of 6.5 or alkali-processed gelatin having an isoelectric point of a pH of 4.9, and polymethyl methacrylate having an average particle size of 2.1μ as a matting agent were used as in Table 4 below, and 1,3,5-triacryloylperhydro-1,3,5-triazine was added as a hardening agent in an amount of 25 mg per g of the binder. The uppermost layer was coated to provide a film thickness of 1.5μ on a dry basis, and then dried at a temperature of 25° C. and a relative humidity of 50% to prepare Samples 11, 12, 13, 14, 15 and 16.

TABLE 4

| Sample | Binder: Acid-Processed Gelatin (%) | Binder: Alkali-Processed Gelatin (%) | Matting Agent (polymethyl methacrylate) (mg/g binder) |
|---|---|---|---|
| 11 | 100 | 0 | 0 |
| 12 | 100 | 0 | 20 |
| 13 | 100 | 0 | 100 |
| 14 | 0 | 100 | 0 |
| 15 | 0 | 100 | 20 |
| 16 | 0 | 100 | 100 |

These samples were subjected to color negative processing at 30° C. in the same manner as in Example 1 and then examined with a microscope at a magnification of 50 times. No reticulation at all was observed with Samples 11, 12 and 13 while marked reticulation was observed with Samples 14, 15 and 16.

In addition, the samples were subjected to adhesion testing in the same manner as in Example 1, and the results shown in Table 5 below were obtained.

TABLE 5

| | Sample 11 | 12 | 13 | 14 | 15 | 16 |
|---|---|---|---|---|---|---|
| Adhered Area (%) | 70 | 10 | 5 | 90 | 80 | 40 |

As is apparent from the results in Table 5 above, acid-processed gelatin is superior in adhesion resistance to alkali-processed gelatin, and when acid-processed gelatin is used in combination with a matting agent, an unexpected improvement is achieved in adhesion resistance.

EXAMPLE 3

A silver halide emulsion layer and a protective layer were coated in that order on both sides of an undercoated polyethylene terephthalate film support and then dried at a temperature of 25° C. and a relative humidity of 60%.

As binders for the protective layer, the same compositions as those in the uppermost layers in Samples 1 to 6 except acid-processed gelatin having an isoelectric point of a pH of 7.2 or alkali-processed gelatin having an isoelectric point of a pH of 5.0 were used to produce Samples 17, 18, 19, 20, 21 and 22.

For the protective layer for each of the Samples 17 to 22, 50 mg of mucochloric acid as a hardening agent and 30 mg of silver bromide having an average grain size of 1.5μ as a matting agent were used per g of the binder, and the thickness of the coated film was 1μ.

For the emulsion layer, 50 mg of mucochloric acid as a hardening agent and 5 mg of 1-phenyl-5-mercaptotetrazole as a stabilizing agent each were used, each per g of gelatin, and silver bromoiodide containing 1.5 mol% of iodide was used. The emulsion layer was coated at a gelatin coverage of 2.48 g/m$^2$ and a silver coverage of 5.00 g/m$^2$.

These samples were kept under the conditions of 25° C. and a relative humidity of 60% for one week, and then subjected to the following processings at 35° C. or 40° C. Then, reticulation was examined for each of the samples.

| Processing Step | |
|---|---|
| Development | 25 seconds |
| Fixation | 25 seconds |
| Washing | 20 seconds |
| **Developer Composition** | |
| Sodium Sulfite | 40 g |
| Hydroquinone | 25 g |
| Boric Acid | 10 g |
| 1-Phenyl-3-pyrazolidone | 1.5 g |
| Potassium Hydroxide | 30 g |
| 5-Methylbenzotriazole | 0.15 g |
| Glutaraldehyde-bisulfite | 15 g |
| Acetic Acid | 12 g |
| Potassium Bromide | 5 g |
| Water to make | 1 l |
| **Fixing Solution** | |
| Ammonium Thiosulfate | 174 g |
| Sodium Sulfite (anhydrous) | 20 g |
| Sodium Tetraborate (decahydrate) | 20 g |
| Acetic Acid | 25 g |
| Sulfuric Acid | 5 g |
| Aluminum Sulfate | 7 g |
| Water to make | 1 l |

In addition, the samples were tested for adhesion in the same manner as in Examples 1 and 2 except for adhering the protective layers to each other, and the ratio of the adhered portions was determined as a percentage. The results of reticulation and adhesion are shown in Table 6 below.

TABLE 6

| | Sample 17 | 18 | 19 | 20 | 21 | 22 |
|---|---|---|---|---|---|---|
| Reticulation Processing Temperature | | | | | | |
| 35° C. | A | A | A | A | A | C |
| 40° C. | B | A | A | A | A | D |
| Adhered Area (%) (temperature 30° C., humidity 90%) | 20 | 20 | 25 | 15 | 20 | 90 |

As is apparent from the results in Table 6 above, the use of acid-processed gelatin is superior in preventing reticulation and superior in adhesion resistance to the use of alkali-processed gelatin, as in Example 1, and when acid-processed gelatin is used in combination with a gelatin derivative or a high molecular weight material containing a carboxyl group or a salt thereof in the uppermost layer, the occurrence of reticulation is more remarkably inhibited.

EXAMPLE 4

A red-sensitive silver halide emulsion layer and an intermediate layer, each containing the additives shown in Table 1 hereinbefore were simultaneously coated in that order on an undercoated cellulose triacetate support using an apparatus similar to that shown in FIG. 10 of U.S. Pat. No. 2,761,791, dried at a temperature of 25° C. and a relative humidity of 60% and a 100 m length of the sample produced was wound around a core of a diameter of 10 cm. However, for the intermediate layer, the same acid-processed gelatin or alkali-processed gelatin as in Example 1 was used as a binder, and the same polymethyl methacrylate as in Example 1 was used as a matting agent in an amount of 5 mg per 1 g of the binder.

The samples wound around the core were kept at a temperature of 25° C. and a relative humidity of 60% for one week, and then unwound and examined for traces of adhesion in portions of the sample near the core.

Substantially no traces of adhesion with the use of acid-processed gelatin were observed while noticeable traces of adhesion were observed with the use of alkali-processed gelatin.

From the above results, it is apparent that when acid-processed gelatin is used in an uppermost layer of a semi-finished product, photographic light-sensitive materials which have excellent adhesion resistance during preparation can be obtained.

The same results were obtained with the use of other binders, matting agents and hardening agents than those used in Examples 1 to 4.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material containing at least one photographic layer containing silver halide and an uppermost layer containing as a binder acid-processed gelatin and polymethylmethacrylate as a matting agent which is powdered and which has average particle sizes of about 0.2 to 10μ.

2. The photographic light-sensitive material of claim 1, wherein said acid-processed gelatin is present in said uppermost layer in an amount greater than about 20% of the total weight of the binders of said uppermost layer.

3. The photographic light-sensitive material of claim 1, wherein said acid-processed gelatin has an isoelectric point of a pH of 6.0 to 9.5.

4. The photographic light-sensitive material of claim 1, wherein said uppermost layer contains one or more additional binders selected from the group consisting of natural high molecular weight materials, chemically modified natural high molecular weight materials other than acid-processed gelatin, and synthetic high molecular weight materials prepared by polymerizing a monomer having an ethylenic double bond.

5. The photographic light-sensitive material of claim 1, wherein said matting agent is present in said uppermost layer in an amount of about 1 to 100 mg/g of the binder present in said uppermost layer.

6. The photographic light-sensitive material of claim 1, wherein said uppermost layer contains a gelatin derivative.

7. The photographic light-sensitive material of claim 1, wherein said uppermost layer contains a synthetic high molecular weight material containing a carboxyl group or a salt of a carboxyl group.

8. The photographic light-sensitive material of claim 1, wherein said uppermost layer contains a hardening agent for said acid-processed gelatin.

9. The photographic light-sensitive material of claim 1, in which the support has thereon a blue-sensitive silver halide emulsion layer containing a yellow forming coupler, a green-sensitive silver halide emulsion layer containing a magenta forming coupler and a red-sensitive silver halide emulsion layer containing a cyan forming coupler.

10. A method for minimizing reticulation in a photographic light-sensitive material containing silver halide on processing said light-sensitive material at a temperature above 30° C. comprising incorporating in said light-sensitive material an uppermost photographic layer containing acid-processed gelatin and polymethylmethacrylate as a matting agent which is powdered and which has average particle size of about 0.2 to 10μ.

* * * * *